United States Patent [19]

Saylor

[11] 4,375,118

[45] Mar. 1, 1983

[54] WIRE CONNECTION

[76] Inventor: Millard P. Saylor, 1125 W. Greenbrier Ct., Arlington Heights, Ill. 60004

[21] Appl. No.: 185,515

[22] Filed: Sep. 9, 1980

[51] Int. Cl.[3] ..... B65D 63/02

[52] U.S. Cl. ..... 24/27

[58] Field of Search ..... 24/26, 27, 28, 29

[56] References Cited

U.S. PATENT DOCUMENTS

| | | | |
|---|---|---|---|
| 185,310 | 12/1876 | France | 24/27 |
| 263,679 | 9/1882 | Campbell | 24/29 |
| 266,587 | 10/1882 | Eastburn | 24/29 |
| 302,243 | 7/1884 | Evans | 24/27 |
| 476,654 | 6/1892 | Kilmer | 24/27 |
| 662,558 | 11/1900 | Dederick | 24/27 |
| 2,032,285 | 2/1936 | Keihl | 24/27 |

OTHER PUBLICATIONS

Billings, G. L. F. Week, 12-1942, p. 4.

*Primary Examiner*—Robert A. Hafer
*Attorney, Agent, or Firm*—Edward D. Gilhooly

[57] ABSTRACT

A connection for releasably securing the ends of an elongated member, such as a wire, used to bale packages or bundles of goods and material. The connection includes a hook or heel supported by a loop configuration which is insertable within a second loop formed on the other end of the elongated member, such that the heel or hook is attached into interconnecting relationship with the second loop. The connection permits the elongated member to be coupled and released as desired during baling and unbaling operations.

13 Claims, 5 Drawing Figures

WIRE CONNECTION

BACKGROUND OF THE INVENTION

This invention relates in general to wire connections, and, in particular, to an improved wire connection releasably to connect the ends of an elongated wire member.

More specifically, but without restriction to the particular use which is shown and described, this invention relates to a wire connection releasably to secure the ends of an elongated member, such as bale wire and the like, employed to secure bales of material for transport and storage. The bale wire connection of the invention includes interconnecting members, which may be interlocked to form a strong coupling of the ends of the bale wires used in securing bulk material and is capable of being easily unhooked after light compression to the wrapped material for ease of removal of the bale wires from the bundle or package for subsequent reuse.

It is common practice to retain a large package or bundle of material, generally referred to as a bale, by means of a plurality of elongated straps, metal wires and the like wrapped around the material. Such baling members thus retain the material in its baled form to enable it to satisfactorily be transported and stored during various stages from its raw form to its final utilization by a textile mill and the like. Many types of material generally are shipped and stored in bales, such as man-made substances in the form of waste paper, wool, man-made fiber staple, cotton, fiberglass and the like.

The use of metallic wire is one of the preferred techniques for securing bales of such material for transport. Bale wire is particularly suitable for use in the securement of bales of cotton that are transported from the gin, where the raw cotton is separated, to the warehouse, where the cotton is stored and later sold for use in textile mills and the like. At the cotton gin, the raw fiber cotton is separated from the remaining plant material and is pressed by a press machine into a bale having a selected density and size. In general, seven different sizes of bales for cotton are accepted for shipment in the United States with varying dimensions and density per cubic foot. The density of the cotton bale compressed at the gin mill may range from a low density bale, requiring six bale wires, to a high 28 pound density one, requiring eight wires for adequate securement.

In use of bale wire for securing cotton bales of the type described, it is standard practice in the industry to apply the tie to the bale at the gin, while the bale is still under compression. The wire is wrapped or looped around the bale, and its ends are conventionally secured together by a square-knot joint or connection, a descriptive term derived from the physical configuration of the wire at the joint. The use of the well known square-knot connection to connect the ties applied to the bale presents several deficiencies in use. The strength of the square-knot connection generally is subject to fracture at a load substantially less than the failure strength of the wire itself. Because of its inherent weakness, the square-knot connection must be situated disadvantageously on the top of the bale, where the least tensile load is encountered. In addition, bale wire is normally wrapped around the bale while the bundle is under compression, and the square-knot joint is coupled by hand. Upon release of the compression applied by the gin press to the bale, the wire tie is subjected to a considerable loading, such that the square-knot configuration of the joint is pulled into a smaller compressed form, which cannot later be readily disengaged.

Generally, the secured cotton bale is then transported from the ginner to the warehouseman, who accepts delivery of the cotton and compresses the package to a greater density for delivery to the user. Upon receipt of the shipment, the warehouseman may employ a machine, known as a "Dinky Press," that applies a compressive load to the bale of cotton received from the ginner for removing the wire ties. After removal of the ties, the bale is further processed by compacting to form a more dense bundle or package, for better efficiency in shipment. The initial removal of the wire ties by the warehouseman is effected by cutting or snipping the wire immediately adjacent the square-knot-type connection, because that type of joint cannot readily be disengaged after it assumes a compressed form.

Obviously, the snipped-off wire joint reduces the length of the bale wire, so that it cannot again be used by the ginner. To reuse the tie applied to the bale by the ginner, the bale wire must be used for another purpose by the warehouseman, such as to secure the more dense bale to be shipped to the user. The reused bale wire is thus passed on to the user and is not returned to the ginner. The square-knot joint or connection is, therefore, both inconvenient to use and considerably weaker in strength than the overall strength of the wire. Moreover, this conventional connection effectively prohibts reuse of the wire by the ginner, because of its reduction in length after being removed at the warehouse. The square-knot connection of the prior art thus offers numerous disadvantages directed to both suitability and economy.

SUMMARY OF THE INVENTION

It is, therefore, an object of this invention to provide an improved connection for the ends of wire and the like.

Another object of this invention is to improve the strength efficiency of a bale wire connection.

A further object of this invention is to provide a bale wire connection capable of readily being coupled and released for removal.

Still another object of this invention is to provide a recyclable bale wire.

A still further object of this invention is to provide an improved wire connection meeting or exceeding all applicable government regulations and facilitating engagement and disengagement.

These and other objects are attained in accordance with the present invention wherein there is provided a wire connection for use as a connecting means for elongated bale wires employed to secure bales of material, such as cotton, waste paper, wool, man-made fiber staple, fiberglass and the like. The wire connection of the invention includes a loop supported heel or a hook, which is insertable into locking relationship with a loop provided at the opposite end of the wire, such that the ends of the bale wire can be readily attached in locking relationship and disengaged for removal of the bale wire from the bales or other bulk packages of material.

Under load, the strength of the wire connection of the invention will range upward in break strength of the wire to approximately 100% of the wire strength. The wire connection thus provides greatly improved strength characteristics over the typical square-knot connection, commonly employed in attaching bale wire ends. The design of the connection of the invention allows the wire tie to be hooked and unhooked with ease to enable female labor, as well as male labor to perform such tasks. Because the connection of the invention may be released without requiring cutting, the length of the wire is not altered by removal as in the prior art techniques and the tie may be recycled as often as feasible after proper inspection.

The improved strength of the wire connection herein disclosed permits its positioning at the side of the bale, where the highest stress points applied to the tie are normally encountered. This advantageous positioning is in contrast to the usual requirement of the square-knot-type connection to be situated at the top of the bale. Accordingly, the wire connection of the invention provides a means for attaching the ends of elongated wire members, such as used in baling applications, in a manner exceeding the government specifications for cotton bale packaging material, as specified by the Commodity Credit Corporation, and yet greatly facilitates hooking and unhooking and permits recycling of the wire.

DESCRIPTION OF THE DRAWINGS

Further objects of the invention, together with additional features contributing thereto and advantages accruing therefrom will be apparent from the following description of preferred embodiments of the invention, which are shown in the accompanying drawings with like reference numerals indicating corresponding parts throughout, wherein.

DESCRIPTION OF PREFERRED EMBODIMENTS

Figure 1:
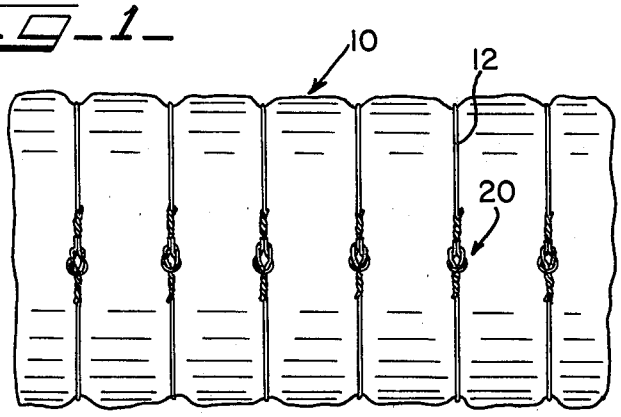
FIG. 1 is a front schematic view of a bale of material being secured by wire employing the wire connection of the invention.

Referring now to FIG. 1, there is illustrated a bale of material 10, such as cotton and the like, being secured or tied by a plurality of wires 12, each coupled by the improved wire connection of the invention, generally designed by the reference numeral 20. Conventionally, a plurality of wire ties are employed, such as, in connection with the baling of cotton, six to eight wire ties dependent on the density of the bale material, as established by the Commodity Credit Corporation. The baling wire or tie 12 is in the form of steel wire that forms a continuous loop about the bale 10, after the ends of the wire are interconnected by the wire connection 20. Generally, the bale wire 12 is applied to the bale 10 while the bundle is being compressed by a typical press machine, such that upon removal from the machine, the wire 12 is subjected to a considerable loading transmitted by the compressed material of the bale 10. As shown in FIG. 1, the wire connection 20 of the invention may be effectively positioned along the sides of the bale 10, at which position the greatest load on the wire is present.

Figure 2:
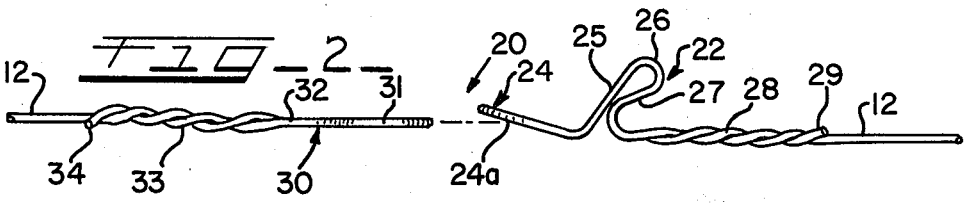
FIG. 2 is a partial side view of one of the bale wires of wire connection of FIG. 1 showing the wire connection of the invention in an unhooked configuration.
Figure 3:
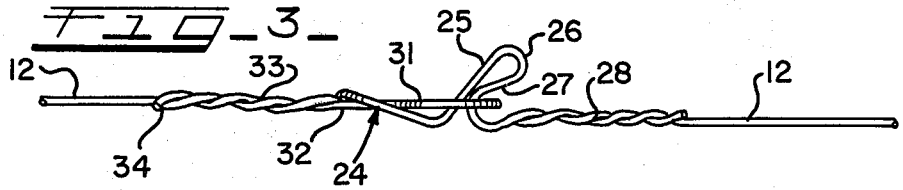
FIG. 3 is a side schematic view of the bale wire connection of the invention in a hooked or locked configuration.
Figure 4:
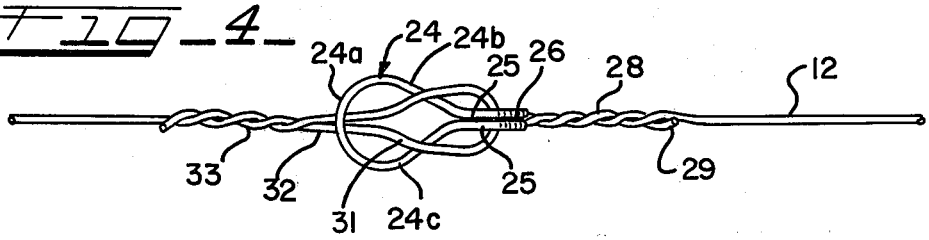
FIG. 4 is a top schematic view of the wire connection of the invention in a hooked or locking configuration.

The first end 22 of the bale tie 12 possess the form shown in FIGS. 2 to 4, by having the end segment of the wire bent backward into the illustrated configuration with another portion of the wire. The end 22 is provided with a loop 24 having a round or circular leading end **24*a* and a pair of rear segments 24*b* and 24*c*, which extend therefrom and form a closed loop disposed in a plane angularly arranged relative to the longitudinal axis of the wire 12. The pair of segments 24*a* and 24*b* extend toward each other and join at a point where a pair of segments 25, lying in close parallel relationship, extend upward in a sloped orientation to form a hook or heel 26. The upper portion of the heel 26 is looped backward in a manner defined by parallel segments 27 that approximately extend to a point closely adjacent segments 25 at that point. The segments 27 then curve in a direction to extend along the longitudinal axis of the wire, and the two strands of the wire form a twisted joint 28 terminating at wire end 29 and having a number of twists depending on desired strength characteristics. It is also within the scope of the invention to wrap one of the strands of wire about the other to form a joint, although the twisted configuration 28 provides superior strength. It should be apparent that the wire end portion 22 includes a loop 24, lying in a plane disposed at a small angle relative to the longitudinal axis of wire 12, while the heel 26 is oriented in a direction away from end portion 22**.

The other end 30 of the tie wire 12, shown in FIG. 2, includes a loop 31 formed by bending back an end portion of the tie wire 12. The width of the loop 31 is less than the loop 24 to permit the insertion of loop 31 through the loop 24. The end portion 30 with the loop 31 thus may be inserted through the loop 24, and the loop 31 is hooked into interconnecting relationship over the heel 26 as best shown in FIGS. 3 and 4. The remaining strands of the wire at end portion 30 close the loop 31 at portion 32 and further form a joint 33 by the two wire strands being twisted together.

From the foregoing, it should be apparent that in the separated form shown in FIG. 2, the connection may be hooked by inserting the loop 31 through loop 24 and over the heel 26, such that upon the tie being in tension a strong connection is formed. The high load to which the bale tie is subjected normally would cause the heel 26 to pull in distorted relationship from its orientation in FIG. 2, except that the loop 24, engaging the portion 32 of the opposite end of the wire, acts to strengthen the heel 26 in a manner to prevent its distortion and maintain it under normal load conditions. The connection is further reinforced by additional contact of the loop 31, during its engagement with heel 26, with areas of loop segments **24*b*, 24*c* at points approximately on the opposite side of the wire section forming loop 24 than wire contact of loop 24 with loop segments 32. To release the connection and to permit re-use of the wire tie 12, the bale may be compressed by means of a conventional pressing machine to reduce the tension on the bale wire, and the connection may be readily unhooked by passing loop 31 over heel 26 and out through loop 24**.

Figure 5:
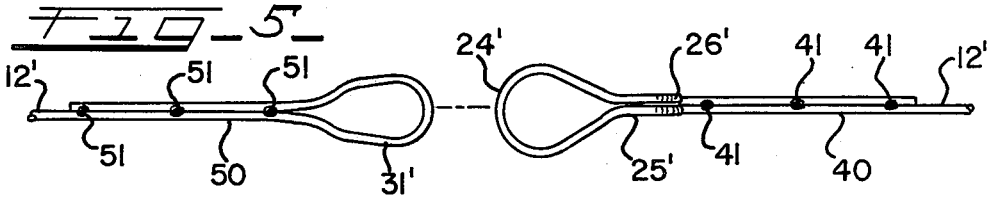
FIG. 5 is a top schematic view of another embodiment of the bale wire connection of the invention.

Referring now to FIG. 5, there is illustrated another embodiment of the invention which is similar to the embodiment illustrated in connection with FIGS. 2 to 4. The similar loops 24' and 31' are disposed on the ends of the wire bale tie 12' and have a configuration substantially identical to that disclosed in the embodiment of FIGS. 2 to 4. However, the strands of the wires are secured together, not by twisted joints 28 and 33, as is the preceding embodiment, but are affixed together by a suitable attachment technique 40 and 50, such as spot welds 41 and 51. The number of spot-welds employed in connection with securing the overlapping portion of the ends of the wire to the tie 12' is dependent on desired strength and selected results.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wire connection for releasably joining two ends of a wire member to form a continuous loop comprising a first end portion of the wire member being formed by a first end segment cooperatively coupled to an adjacent segment of the wire member, said first end segment forming an integral extension of the wire member, said first end segment being bent back to form a first closed loop lying in a first plane and an integral hooking means disposed between said first loop and said adjacent segment, a second end portion of the elongated wire member formed by a second end segment being cooperatively coupled to a second adjacent segment of the wire member, said second end segment forming an integral extension of the wire member and being bent back to form a second loop lying in a second plane, said second closed loop being arranged to be inserted through said first closed loop with said first and second planes intersecting and being disposed in a near parallel relationship, said second closed loop further being arranged to releasably engage said hooking means in contacting relationship after insertion through said first loop to couple said first and second end portions by a secure connection, said second closed loop contacting said first closed loop at spaced areas on one side of said first closed loop and at at least one area on the opposite side of said first loop during engaging contact of said second closed loop with said hooking means to reinforce said first end portion, said contact preventing substantial deformation of said first end portion during expected loading of said wire connection for selected release and reuse of said connection.

2. The wire connection according to claim 1 wherein said first closed loop lies in a plane disposed in nonalignment to the longitudinal axis of the wire member.

3. The wire connection according to claim 2 wherein said second closed loop lies in a plane coextensive with longitudinal axis of the wire member.

4. The wire connection according to claim 1, said first and second end segment is attached to a portion of said adjacent segment and said second adjacent segment respectively.

5. The wire connection according to claim 4 wherein said first and second segments are in twisted engagement with said adjacent segment and said second adjacent segment, respectively.

6. The wire connection according to claim 4 wherein said first and second end segments are welded to a portion of said adjacent segment and said second adjacent segment, respectively.

7. A wire connection comprising a first loop formed on an integral end portion of an elongated wire, hook means integrally formed on said end portion adjacent said first loop and creating a rigid member projecting outward to retain a loop in engagement therewith, a second loop formed at the opposite integral end portion of the wire, said second loop being arranged to be inserted through said first loop for releasable engagement with said hook means to connect the ends of the wire, the planes of said first and second loops intersecting and being disposed relative to each other in a near parallel relationship, said second loop acting to contact said first loop at a pair of areas on one side thereof and at at least one area on the opposite side of said first loop during contact of said second loop with said hooking means, said contact preventing collapse of said first and second loops under loading and permitting release of said second loop from said hook means for selected reuse of the connection after release thereof.

8. The wire connection according to claim 7 wherein said first and second loops are supported by twisted portions of the wire.

9. The wire connection according to claim 7 wherein said first and second loops are supported by portions of the wire being welded together.

10. The wire connection according to claim 7 wherein said first loop is in a plane disposed in nonalignment to the longitudinal axis of the wire.

11. The wire connection according to claim 7 wherein said hook means includes a hooking portion extending away from said first loop.

12. A wire connection comprising a first closed loop formed on an end portion forming an integral extension of a wire, a heel integrally formed on said end portion of the wire adjacent said first closed loop to form a loop retaining hook, said first loop and heel being created by said end portion being bent back and affixed to an adjacent portion of the wire, said heel being disposed between said adjacent portion of the wire and said first closed loop, a second closed loop formed on the opposite end portion forming another integral extension of the wire, said second loop being arranged for insertion through said first loop for engaging contact with said heel, said second loop being disposed through said first loop after insertion with the planes of said first and second loops intersecting and being disposed in a near parallel relationship, and, said second loop contacting said first loop at a pair of points on one side thereof, and at least one point at the opposite side of said first loop during engagement with said heel, said contact acting to form a substantially non-deformable connection joining the two end portions of the wire to form a continuous wire loop.

13. The wire connection according to claim 12 wherein said first and second loop attain mutual contact during engagement of said second loop with said heel.

* * * * *